United States Patent [19]

Berglund

[11] Patent Number: 4,573,601

[45] Date of Patent: Mar. 4, 1986

[54] SCREW CAP WITH SECURITY RING

[75] Inventor: Jan Berglund, Västra Frölunda, Sweden

[73] Assignee: Wicanders AB, Sweden

[21] Appl. No.: 665,024

[22] Filed: Oct. 26, 1984

Related U.S. Application Data

[63] Continuation-in-part of Ser. No. 526,030, Aug. 24, 1980, Pat. No. 4,505,401.

[30] Foreign Application Priority Data

Jun. 1, 1983 [SE] Sweden ..... 8303099
May 15, 1984 [GB] United Kingdom ..... 8412344

[51] Int. Cl.[4] ..... B65D 41/34
[52] U.S. Cl. ..... 215/252; 215/258
[58] Field of Search ..... 215/252, 253, 258

[56] References Cited

U.S. PATENT DOCUMENTS

| | | | |
|---|---|---|---|
| 3,455,478 | 7/1969 | Fields et al. | 215/252 |
| 4,197,955 | 4/1980 | Luenser . | |
| 4,452,363 | 6/1984 | Davis | 215/258 |
| 4,461,391 | 7/1984 | Davis | 215/252 |
| 4,471,878 | 9/1984 | Davis et al. | 215/258 X |

FOREIGN PATENT DOCUMENTS

| | | | |
|---|---|---|---|
| 0052804 | 6/1982 | European Pat. Off. . | |
| 0080846 | 6/1983 | European Pat. Off. | 215/252 |
| 0096351 | 12/1983 | European Pat. Off. . | |
| 2298255 | 8/1976 | France . | |
| 268186 | 3/1927 | United Kingdom . | |

*Primary Examiner*—Steven M. Pollard
*Attorney, Agent, or Firm*—Brumbaugh, Graves, Donohue & Raymond

[57] ABSTRACT

The invention relates to a screw cap for a container neck, comprising an internally threaded cap portion (1) and a security ring (6) joined by means of inclined bridge portions (7) to the cap portion. The sealing ring (6) is resiliently deformable and is designed to be forced over and past a collar (5) around the neck of the container, when the cap is being screwed on for the first time. Recesses (8, 9) are provided in the lower part of the cap portion and/or the upper part of the sealing ring, in which recesses the bridge portions (7) are secured. The bridge portions are so inclined that the upper edge of the security ring can engage the lower edge of the cap skirt when, during screwing on of the cap for the first time, the security ring (6) engages the collar (5), without undue bending of the bridge portions (7), so that the cap portion can support the security ring (6) while the latter is forced over the collar (5). However, when the cap is unscrewed, and the security ring is stopped by the collar (5), the bridge portions are first bent substantially at their ends, and thereby weakened, and are tensioned, to rupture, during continued unscrewing of the cap portion. The security ring is further provided with weakening points (15) at one or more of the bridge connections.

18 Claims, 6 Drawing Figures

SCREW CAP WITH SECURITY RING

CROSS REFERENCE TO RELATED APPLICATIONS

This application is a continuation-in-part of U.S. Ser. No. 526,030, filed Aug. 24, 1983, now U.S. Pat. No. 4,505,401 issued on Mar. 19, 1985.

FIELD OF THE INVENTION

This invention relates to a screw cap comprising an internally threaded cap-portion and a security ring joined with the cap portion by means of breakable bridge portions.

BACKGROUND OF THE INVENTION

Screw caps of this type, in which the security ring is resiliently deformable, are already known. The security ring is designed to be forced over and past a collar arranged around the neck of a container to be sealed, when the cap is screwed onto the neck of the container for the first time. The security ring, collar and bridge portions are shaped and dimensioned so that when, after the cap has been fully screwed on for the first time, it is subsequently unscrewed, the security ring is retained by engagement with the collar and the bridge portions are broken as the cap portion is unscrewed.

In previously known screw caps of this type, it has been extremely difficult to shape and dimension the bridge portions and to devise their attachment to the cap-portion and/or sealing ring so that the bridge portions do not break when the cap is screwed on for the first time, but break easily when the cap is subsequently unscrewed.

U.S. Pat. No. 3,455,478 to Fields et al. describes a screw cap of this type in which an attempt is made to solve the latter problem by inclining the bridges forwards and downwards, where the cap is considered as being turned forwards and downwards to screw the cap onto the respective container neck. The bridges are thus subject to compression loading when the cap is being screwed on for the first time and to loading in tension when the cap is being screwed off for a first time. The aim is to utilize the feature of certain materials particularly plastics, of withstanding compression loading better than loading in tension. A problem with the screw cap shown in this U.S. Patent is that the bridges must be made extremely thin and narrow of their attachment points to the lower part or skirt of the cap portion, in order to permit the cap to be screwed off with reasonably little exertion of force and at the same time achieve rupture at the points of attachment of the bridge portions. However, such thin, narrow attachment points are subjected to considerable shearing forces when the cap is screwed on and sealed in the normal way. This necessitates the use of a complicated machine, which grips both cap portion and security ring. If the bridges at their attachment points are made strong enough to withstand rupture when the cap is screwed on the bottle in a standard machine, the force needed to break the bridges when the cap is unscrewed will be too high.

SUMMARY OF THE INVENTION

One of the objects of the present invention is to provide a screw cap with a security ring, which is less sensitive to variations in the shape and attachment of the bridges than known caps and is therefore better fitted for mass production. Another object of the invention is to provide a cap, which can be equipped with one or more extra details in the design to make it more suitable for different applications.

According to one aspect of the invention, there is provided a screw cap for a screw threaded container neck, the cap comprising an internally threaded cap portion having a head and a skirt extending from said head to a skirt edge, and further comprising a security ring adjoining said skirt edge and having an edge opposing said skirt edge, the security ring effectively constituting a continuation of said skirt, away from said head, beyond said skirt edge, at least one of said opposing edges of the skirt and the security ring having a plurality of recesses open towards the other said edge, said recesses being distributed around the circumference of the cap, the cap further including a plurality of bridge portions connecting the cap with the securing ring, each said bridge portion being disposed in a said recess and extending from a respective first point on the security ring to a respective second point on the cap skirt which is located in advance of the respective first point in the rotational sense in which, according to the internal threading of the cap, the cap must be turned to screw it onto a container neck, whereby when the cap is screwed onto a container neck having a collar for engagement with said security ring, after the security ring engages said collar, further screwing on of the cap will cause the skirt edge of the cap skirt to press against the opposing edge of the security ring after, at most, relatively slight bending of the bridge portions at said first and second points, to allow the cap portion to force the security ring past said collar, whilst after the cap has been fully screwed onto a container and neck and is subsequently unscrewed therefrom, after the security ring engages said collar to be retained thereby, the bridge portions will be subjected to relatively great bending at said first and second points whilst being tensioned and thereby fractured, said security ring being further provided with weakening points at one or more of the bridge connections.

According to another aspect of the invention, there is provided a container having a neck terminating in an opening, an external screw thread around said neck and an external collar around said neck, further from said opening than said external screw thread, and a screw cap for said neck, the cap comprising an internally screw threaded cap portion for screwing onto said neck, the cap portion having a head and a skirt extending from said head to a skirt edge, and further comprising a security ring for cooperation with said collar, the security ring adjoining said skirt edge and having an edge opposing said skirt edge, the security ring effectively constituting a continuation of said skirt, away from said head, beyond said skirt edge, at least one of said opposing edges of the skirt and the security ring having a plurality of recesses open towards the other said edge, said recesses being distributed around the circumference of the cap, the cap further including a plurality of bridge portions connecting the cap with the security ring, each said bridge portion being disposed in a said recess and extending from a respective first point on the security ring to a respective second point on the cap skirt which is located in advance of the respective first point in the rotational sense in which, according to the screw threading on the cap and container neck, the cap must be turned to screw it onto the container neck, the security ring being dimensioned to clear the screw thread on the container neck during such screwing on of the cap, but to engage said collar, the collar and security ring being configured to promote resilient deformation of the security ring to allow the same to pass over the collar during screwing on of the cap for the first time, but to prevent subsequent withdrawal of the security ring over the collar, whereby, when the cap is screwed onto the container neck for the first time, after the security ring engages said collar, further screwing on of the cap will cause the skirt edges to press against the opposite edge of the security ring after, at most, relatively slight bending of the bridge portions, at said first and second points to allow the cap portion to force the security ring past said collar, whilst after the cap has been fully screwed onto the container neck and is subsequently unscrewed, after the security ring engages the collar to be prevented thereby from being withdrawn further, the bridge portions will be subjected to relatively great bending at said first and second points whilst being tensioned as the cap portion is unscrewed and will thereby be fractured allowing removal of the cap portion, said security ring being further provided with weakening points at one or more of the bridge connections.

To secure a good function of the cap and make it more suitable for special applications the invention foresees some extra details, which can be included in the above described design of the cap. These will be described in detail in the description of preferred embodiments which follow below.

An embodiment of the invention is described below with reference to the accompanying drawings in which:

DESCRIPTION OF PREFERRED EMBODIMENTS

Figure 1:
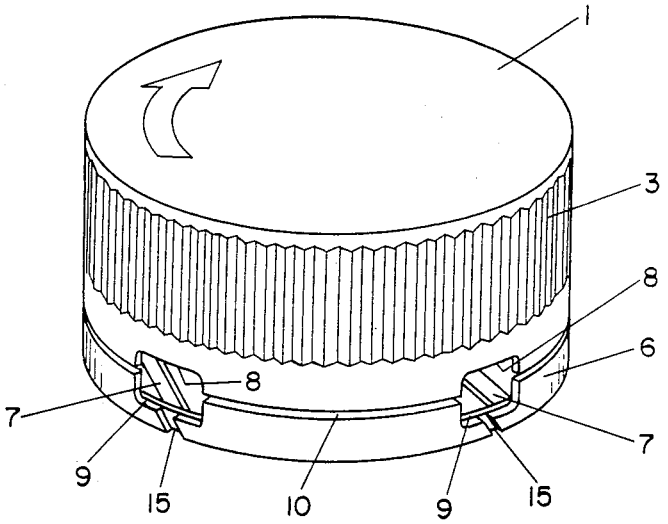
FIG. 1 is a perspective view of a screw cap embodying the invention.
Figure 2:
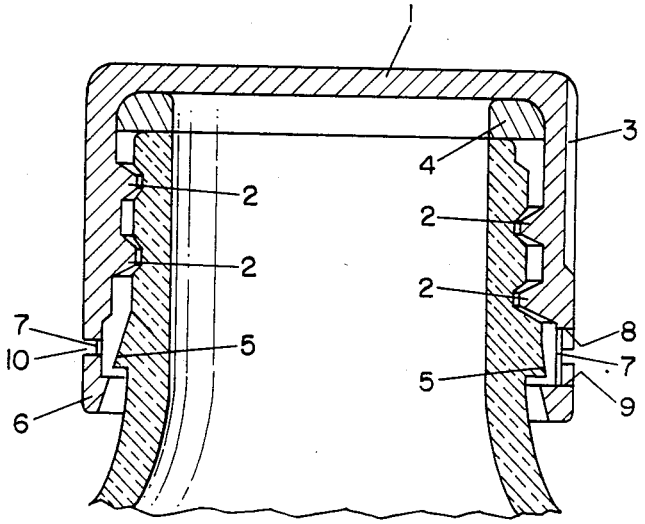
FIG. 2 is an axial section view of the screw cap of FIG. 1 when screwed onto a container.

Referring to FIGS. 1 and 2, a screw cap for a container neck includes a cap portion 1 having a flat head and a skirt provided with internal screw threads 2 fitting complementary threads in the neck of container, and external corrugations 3 in the form of axially directed ridges to provide grip for screwing and unscrewing the cap. A sealing annular washer 4 is clamped between the head of the cap portion 1 and the free end of the container neck. The container neck, below the external screw thread thereon, is provided externally with a circumferential annular collar 5, which is of saw-tooth form in cross-section providing a ramp face gradually increasing in outer diameter downwardly to meet, in a relatively sharp edge, with a downwardly facing abutment face substantially perpendicular to the axis of the container neck. A security ring 6 is attached to the lower edge of the skirt of the cap portion by means of four or more bridge portions 7, two of which are shown in the figures. The bridge portions are arranged at regular intervals around the circumference of the cap. The security ring adjoins the free edge of the cap skirt and effectively constitutes a continuation of said skirt, away from the head of the cap. The bridge portions 7 are each elongate in form, and each is attached at one end, at a respective first point, to the security ring and at its other end, at a respective second point, to the cap skirt.

The bridge portions are inclined forwardly and upwardly in the direction of screwing on of the cap, so that each said second point is located in advance of the respective first point in the rotational sense in which the cap is screwed on. The inclination of each bridge portion, i.e. the inclination of an imaginary straight line passing through the respective first and second points, relative to a plane perpendicular to the rotational axis of the cap, is 45° in the arrangement shown, and is preferably between 45° and 75°. Each bridge portion is disposed in a respective space defined by a respective recess 8 in the cap skirt and a respective, registering recess in the edge of the security ring, each bridge portion extending from the bottom of the respective recess 8 to the bottom of the respective recess 9. As a result of this construction and mode of attachment, when the cap portion is twisted very slightly relative to the security ring in the direction appropriate to screwing on, during screwing of the cap onto the container neck for the first time, after the security ring has engaged the ramp face of the collar 5, the security ring is moved into engagement with the cap skirt, the skirt edge engaging the opposing edge of the security ring, i.e. the narrow gap 10 between the cap portion and the sealing ring is temporarily closed. Due to the friction thus achieved between cap portion and security ring, the bridge portions will only be subjected to a very limited tensile strength during the further part of the screwing on phase in which the security ring is forced downwardly, and thus resiliently outwardly, over the collar 5. The bridge portions can thus be made relatively weak and will therefore be relatively easy to break in the screwing off phase discussed below.

Figure 3:
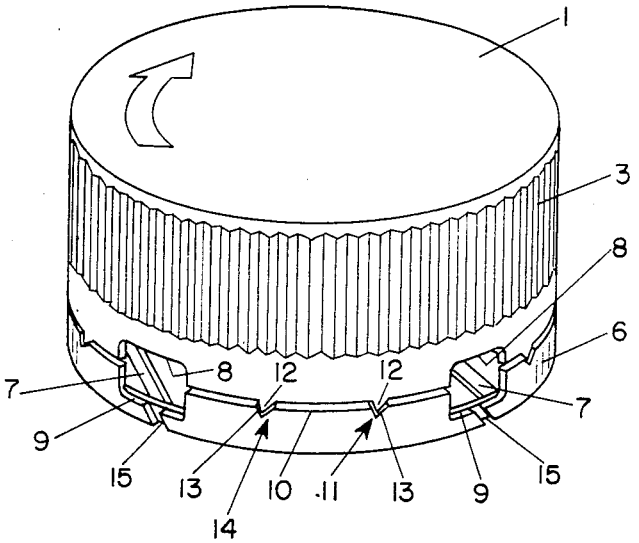
FIG. 3 is a perspective view of another form of screw cap embodying the invention.

In an alternative embodiment of the screw cap illustrated in FIG. 3, the opposing edges of the cap skirt and the security ring are provided with cooperating engagement means 11 to ensure that the security ring is entrained rotationally with the cap when the cap is screwed on. The means 11 in the embodiment shown in FIG. 3, consists of one or more teeth 12 on the skirt edge and one or more corresponding notches 13 on the opposite edge of the security ring, the teeth 12 and notches 13 being of sawtooth or ratchet tooth form in the arrangement shown. When the cap is screwed on, said teeth and notches cooperate with one another and thereby ensure that the sealing ring is entrained rotationally with the cap portion. When the cap is unscrewed, the axial separation which occurs when the security ring abuts the collar and is stopped the inclined means 14 on the back edge of the teeth and notches help the security ring to be separated from the cap portion by increasing the force applied on the bridges.

When the cap portion is screwed off for the first time, the security ring will initially follow the rotary and axial movement of the cap portion but cannot be drawn back past the abutment face of the collar 5. The bridge portions are thus bent towards, and subsequently past, parallelism with the cap axis whilst being placed in tension during continued unscrewing of the cap portion. Due to the initially inclined positions of the bridge portions the bridge portions are locally weakened at their attachment points with the cap skirt and the security ring and if unscrewing is continued, the bridge portions will be broken at these attachment points. The bending of the bridge portions at their points of attachment with the skirt and security ring weakens the bridge portions at these points and facilitates their subsequent fracture under tension. The security ring will thus remain below the collar, indicating that the container has been opened. By introducing a weakening at one or other end of the bridges during manufacture of the screw cap, the bridges can be caused to break at the desired ends, preferably at their ends connected with the cap skirt, so that the bridge portions remain as a fringe around the sealing ring. It is also possible to weaken the bridges in different degrees to make it possible to control the order in which the bridges are broken. The breaking order for the bridges can also be controlled by varying the inclination of the bridges, as a bridge which is almost parallel to the rotational axis obviously will be put under stress earlier when the cap is unscrewed than a bridge with an inclination of for example 45°.

As can be seen in the drawings, the bridge portions are preferably thinner in the radial direction than the cap skirt. In other embodiments the number of bridge portions may be from 3 to 12, preferably from 4 to 8, the bridge portions in each case preferably being arranged at regular intervals around the cap, so that the circumferential distance between adjacent bridge portions is constant.

Figure 4A:
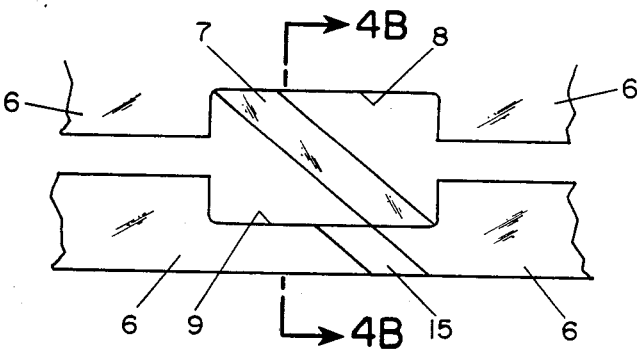
FIG. 4A is a side detail view showing a weakening point on the security ring.
Figure 4B:
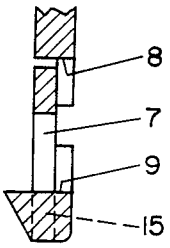
FIG. 4B is a cross-sectional view of the security ring shown in FIG. 4A taken at section line B—B.

To make it possible for the security ring to break and follow the cap when the cap is unscrewed, the ring can be provided with one or more weakening points 15 placed in close connection to the bridges preferably on the front side of the bridge seen in the screw direction, when the cap is screwed onto the bottle (FIGS. 4A, 4B).

Figure 5:
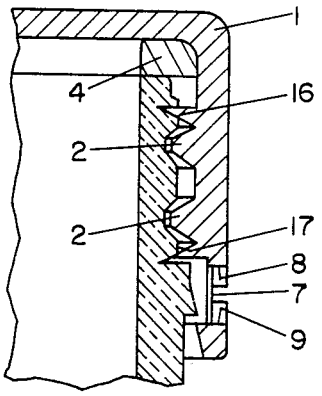
FIG. 5 is a sectional view of a cap with two ring-shaped sealing elements.

As the cap has to be unscrewed a certain distance before the bridges start to break and indicate that the cap has been opened, it can happen that the annular washer 4 looses contact with the bottle top and leakage into or out of the bottle can take place. To prevent or minimize this leakage the cap can be provided with one or more ringshaped sealing elements 16, 17 positioned around the inner surface of the cap just above and/or somewhat below the threaded part. These sealing elements are given an inner diameter suitable for making them seal against the smooth cylindrical parts of the bottle neck above and below the threaded part (FIG. 5).

Each of the screw caps described with reference to the drawings is manufactured most advantageously in a single, i.e. monolithic homogenous piece, for instance from a suitable plastics material such as polyethylene or, preferably, polypropylene. The material used is, in any case, preferably a resiliently deformable material or an elastomeric material. Manufacture is effected preferably by injection moulding in known manner and with straight or screw ejection from the moulding tool.

Whilst, in the embodiments shown, each bridge portion is disposed in a space defined by two registering recesses, one in the cap skirt and one in the security ring, if desired only the cap skirt, or only the security ring may be provided with recesses, each bridge portion in this case extending from the bottom of a respective recess to the unrecessed opposed edge of the security ring or cap skirt.

What is claimed is:

1. A screw cap for a screw threaded container neck, the cap comprising an internally threaded cap portion having a head and a skirt extending from said head to a skirt edge, and further comprising a security ring adjoining said skirt edge and having an edge opposing said skirt edge, the security ring effectively constituting a continuation of said skirt, away from said head, beyond said skirt edge, at least one of said opposing edges of the skirt and the security ring having a plurality of recesses open towards the other side edge, said recesses being distributed around the circumference of the cap, the cap further including a plurality of bridge portions connecting the cap with the security ring, each said bridge portion being disposed in a said recess and extending from a respective first point on the security ring to a respective second point on the cap skirt which is located in advance of the respective first point in the rotational sence in which, according to the internal threading of the cap, the cap must be turned to screw it onto a container neck, whereby when the cap is screwed onto a container neck having a collar for engagement with said security ring, after the security ring engages said collar, further screwing on of the cap will cause the skirt edge of the cap skirt to press against the opposing edge of the security ring after, at most, relatively slight bending of the bridge portions at said first and second points, to allow the cap portion to force the security ring past said collar, whilst after the cap has been fully screwed onto a container and neck and is subsequently unscrewed therefrom, after the security ring engages said collar to be retained thereby, the bridge portions will be subjected to relatively great bending at said first and second points whilst being tensioned and thereby fractured, said security ring being further provided with weakening points at one or more of the bridge connections.

2. The screw cap of claim 1, in which said skirt edge has a plurality of said recesses therein and wherein said opposing edge of the security ring has, for each said recess in said skirt edge, a respective recess in register therewith, each said bridge portion extending from the bottom of one said recess to the bottom of the registering recess.

3. The screw cap of claim 1, in which said recesses in which the bridge portions are located, are provided only in the cap skirt.

4. The screw cap of claim 1, in which said recesses in which the bridge portions are secured, are provided only in the security ring.

5. The screw cap of claim 4, wherein the cap has been manufactured in one piece by injection moulding.

6. The screw cap of claim 1, in which there are from 3 to 12 such bridge portions.

7. The screw cap of claim 1, which comprises a plurality of said bridge portions disposed at regular intervals around the circumference of the cap.

8. The screw cap of claim 1, in which the cap portion, sealing ring and bridge portions are formed integrally with one another and constitute a single homogenous body of plastic material.

9. The screw cap of claim 8, in which said plastics materials is polypropylene.

10. The screw cap of claim 1, in which, in each said bridge portion, said first and second points lie on a respective straight line inclined at an angle of between 45° and 90° to a plane perpendicular to the rotational axis of the screw cap.

11. The screw cap of claim 1, comprising engagement means on said cap skirt and said security ring, the engagement means on the cap skirt being engageable with the engagement means on the security ring to transfer to the security ring a torque applied to the cap portion to screw the cap portion onto a container neck.

12. The screw cap of claim 11, in which said engagement means comprise complementary teeth and notches.

13. The screw cap of claim 12 in which said complementary teeth and notches have axial directed front edges, which are engaged when the cap is screwed onto the bottle and inclined back edges which are engaged in the beginning when the cap is unscrewed.

14. The screw cap of any one of the claims 1–7 in which one or more of the bridges are provided with weakening points at the connection to the cap portion.

15. The screw cap of claim 1 in which the bridges are made with two or more different inclinations.

16. The screw cap of claim 1 in which the weakening points in the security ring are placed on the front side of the bridges.

17. The screw cap of claim 1 in which one or more ringshaped sealing elements are placed around the inner surface of the cap above and/or below the threaded part of the cap.

18. A container having a neck terminating in an opening, an external screw thread around said neck and an external collar around said neck, further from said opening than said external screw thread, and a screw cap for said neck, the cap comprising an internally screw threaded cap portion for screwing onto said neck, the cap portion having a head and a skirt extending from said head to a skirt edge, and further comprising a security ring for cooperation with said collar, the security ring adjoining said skirt edge and having an edge opposing said skirt edge, the security ring effectively constituting a continuation of said skirt, away from said head, beyond said skirt edge, at least one of said opposing edges of the skirt and the security ring having a plurality of recesses open towards the other said edge, said recesses being distributed around the circumference of the cap, the cap further including a plurality of bridge portions connecting the cap with the security ring, each said bridge portion being disposed in a said recess and extending from a respective first point on the security ring to a respective second point on the cap skirt which is located in advance of the respective first point in the rotational sense in which, according to the screw threading on the cap and container neck, the cap must be turned to screw it onto the container neck, the security ring being dimensioned to clear the screw thread on the container neck during such screwing on of the cap, but to engage said collar, the collar and security ring being configured to promote resilient deformation of the security ring to allow the same to pass over the collar during screwing on of the cap for the first time, but to prevent subsequent withdrawal of the security ring over the collar, whereby, when the cap is screwed onto the container neck for the first time, after the security ring engages said collar, further screwing on of the cap will cause the skirt edges to press against the opposing edge of the security ring after, at most, relatively slight bending of the brdige portions, at said first and second points to allow the cap portion to force the security ring past said collar, whilst after the cap has been fully screwed onto the container neck and is subsequently unscrewed, after the security ring engages the collar to be prevented thereby from being withdrawn further, the bridge portions will be subjected to relatively great bending of said first and second points whilst being tensioned as the cap portion is unscrewed and will thereby be fractured allowing removal of the cap portion, said security ring being further provided with weakening points at one or more of the bridge connections.

* * * * *